US008099015B2

(12) United States Patent
Ito

(10) Patent No.: US 8,099,015 B2
(45) Date of Patent: Jan. 17, 2012

(54) DEVELOPING DEVICE, PROCESS CARTRIDGE, IMAGE FORMING DEVICE, AND DEVELOPER CONTAINER

(75) Inventor: Isao Ito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 360 days.

(21) Appl. No.: 12/366,957

(22) Filed: Feb. 6, 2009

(65) Prior Publication Data

US 2010/0034554 A1 Feb. 11, 2010

(30) Foreign Application Priority Data

Aug. 7, 2008 (JP) ..... 2008-204119

(51) Int. Cl.
*G03G 15/08* (2006.01)

(52) U.S. Cl. ..... 399/106; 399/103; 399/105

(58) Field of Classification Search ..... 399/106
See application file for complete search history.

(56) References Cited

U.S. PATENT DOCUMENTS

| | | | | |
|---|---|---|---|---|
| 5,822,653 | A * | 10/1998 | Ishii | 399/106 X |
| 2007/0280725 | A1 | 12/2007 | Hosokawa et al. | 399/103 |

FOREIGN PATENT DOCUMENTS

| | | | |
|---|---|---|---|
| JP | 60-101566 | A | 6/1985 |
| JP | 2-198475 | A | 8/1990 |
| JP | 05-204246 | | 8/1993 |
| JP | 07-168444 | | 7/1995 |
| JP | 08-137233 | | 5/1996 |
| JP | 09-026743 | | 1/1997 |
| JP | 2000-227714 | | 8/2000 |
| JP | 2001-125357 | | 5/2001 |
| JP | 2002-351202 | | 12/2002 |
| JP | 2005-92051 | A | 4/2005 |
| JP | 2007-298828 | A | 11/2007 |
| JP | 2008-15022 | A | 1/2008 |

* cited by examiner

*Primary Examiner* — David Gray
*Assistant Examiner* — Erika J Villaluna
(74) *Attorney, Agent, or Firm* — Morgan, Lewis & Bockius LLP

(57) ABSTRACT

A developing device includes: a housing that has a developer containing part and an opening, the developer containing part containing a developer, and the opening allowing the developer to flow through; a sheet member that is provided in the housing, seals the opening when unused, and is pulled out in one direction to open the opening when used; and a loosening regulation unit that is provided on the housing or the sheet member, and regulates loosening of the sheet member, wherein the housing has a guide hole, the guide hole allowing the sheet member to be inserted in when sealing the opening with the sheet member, and guiding the sheet member when the sheet member is pulled out.

17 Claims, 6 Drawing Sheets

DEVELOPING DEVICE, PROCESS CARTRIDGE, IMAGE FORMING DEVICE, AND DEVELOPER CONTAINER

CROSS-REFERENCE TO RELATED APPLICATIONS

This application claims priority under 35 USC 119 from a Japanese patent application No. 2008-204119 filed on Aug. 7, 2008.

BACKGROUND

1. Technical Field

The present invention relates to a developing device, a process cartridge, an image forming device, and a developer container.

2. Related Art

In recent years, a large number of recording devices/printers utilizing electrophotographic principles, with improved operationality have been introduced in the market. These improved devices are provided with a cartridge (a so-called process cartridge), which integrates members for executing an electrophotographic process.

Further, components constituting such a process cartridge are improved to meet demands for downsizing of recording devices. One such component is a developing device. In the developing device, a developer container part is formed in advance. The developer in the developer container part is transported outside through an outlet opening.

SUMMARY

The invention provides a developing device, a process cartridge, an image forming device, and a developer container, which prevent a sheet member from being cut when the sheet member is pulled out to open an opening.

According to one aspect of the invention, a developing device includes: a housing that has a developer containing part and an opening, the developer containing part containing a developer, and the opening allowing the developer to flow through; a sheet member that is provided in the housing, seals the opening when unused, and is pulled out in one direction to open the opening when used; and a loosening regulation unit that is provided on the housing or the sheet member, and regulates loosening of the sheet member, wherein the housing has a guide hole, the guide hole allowing the sheet member to be inserted in when sealing the opening with the sheet member, and guiding the sheet member when the sheet member is pulled out.

BRIEF DESCRIPTION OF THE DRAWINGS

An exemplary embodiment of the present invention will be described in detail based on the following figures, wherein.

DETAILED DESCRIPTION

1. Whole Structure of Image Forming Device

Figure 1:
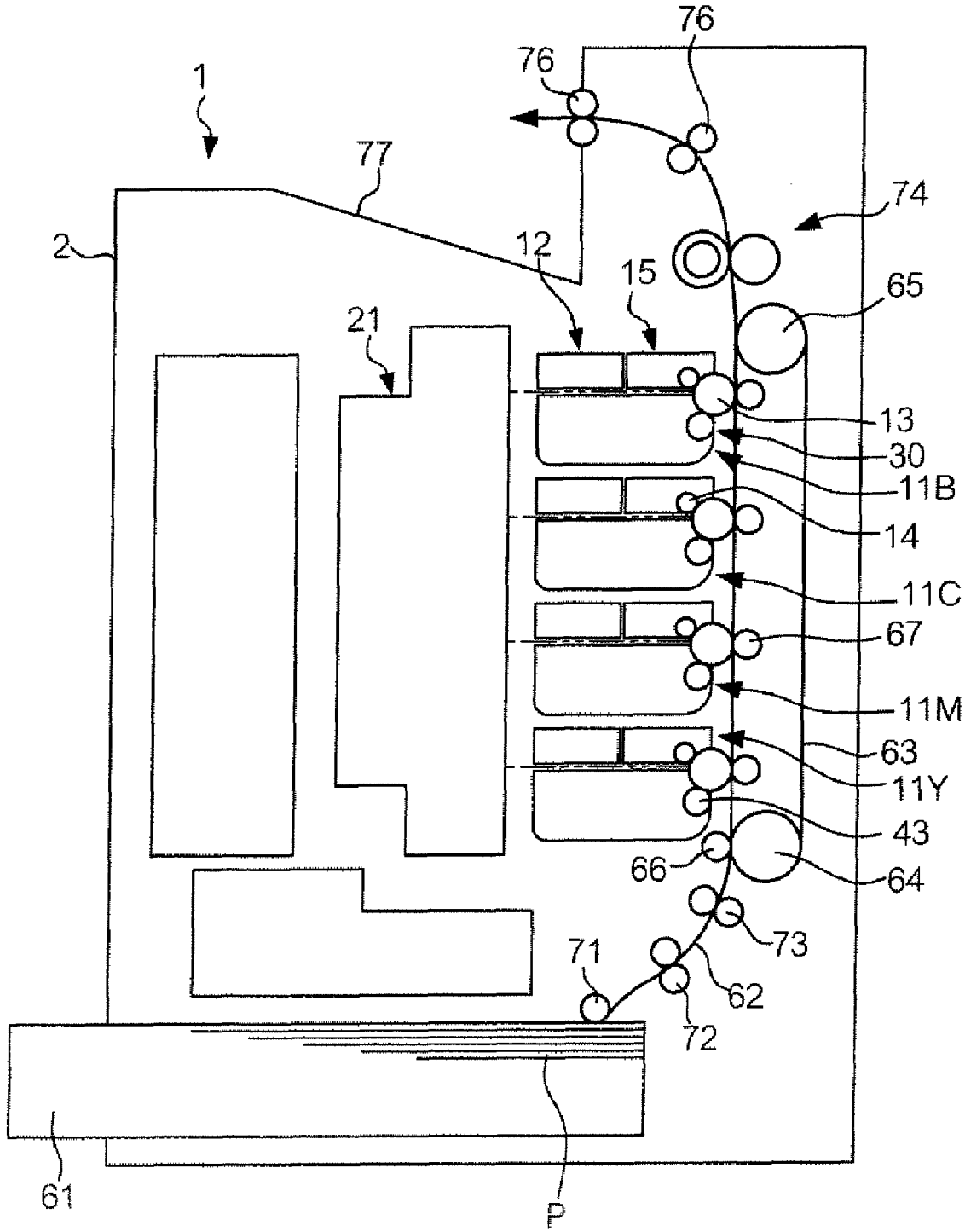
FIG. 1 shows a whole structure of an image-forming device according to an exemplary embodiment of the invention.

FIG. 1 shows a whole structure of an image-forming device 1 in which a developing device according to the exemplary embodiment is used.

The image-forming device 1 is a color image-forming device of a so-called tandem type. In a device housing 2) image-forming units 11 (e.g., 11Y, 11M, 11C, and 11B) for four colors (yellow, magenta, cyan, and black in this exemplary embodiment) are arrayed in a longitudinal direction. Below the image-forming units 11, there is provided a sheet feed cassette 61, which contains paper sheets P to be supplied. Through positions corresponding to the image-forming units 11, a sheet conveyance path 62 is set extending in a longitudinal direction, and serves as a route for conveying the paper sheets P from the sheet feed cassette 61.

The image-forming units 11 function to form toner images for yellow, magenta, cyan, and black colors, in an order from an upstream side of the sheet conveyance path 62. Each of the image-forming units 11 has a process cartridge and an exposure device 21. Various process units are built into the process cartridge 12, and the exposure device 21 illuminates the process cartridge 12 with scanning light for forming images.

The process cartridge 12 integrates, into one cartridge, a photo-sensitive drum 13, an electric charge roll 14, a developing device 30, and a cleaning device 15. The electric charge roll 14 electrically charges the photo-sensitive drum 13 in advance. The developing device 30 visualizes an electrostatic latent image by a color toner (having a negative polarity in this exemplary embodiment), wherein the electrostatic latent image has been exposed and formed on the electrically charged photo-sensitive drum 13 by the exposure device 21. The cleaning device 15 removes a waste toner on the photo-sensitive drum 13. The developing device 30 is detachably attached to a base of the process cartridge 12 (not shown in the figures).

Meanwhile, the exposure device 21 has a semiconductor laser, a polygon mirror, an imaging lens, and a mirror, which are contained in a casing. A light beam from the semiconductor laser is deflected by the polygon mirror, so as to scan exposure points on the photo-sensitive drum 13 by guiding a light image through the imaging lens and the mirror.

Further, a conveyor belt 63 is provided, which circulates and moves along the sheet conveyance path 62 and extends through positions corresponding to the photo-sensitive drums 13 of the image forming units 11. The conveyor belt 63 is made of a belt material (rubber or resins) capable of electrostatically attracting a paper sheet P, and is wound between a pair of tension rolls 64 and 65.

A sheet attraction roll 66 is provided at a start position of the conveyor belt 63 (i.e., a position opposite the tension roll 64). As a high attraction voltage is applied to the sheet attraction roll 66, a paper sheet P is attracted by the conveyor belt 63. Transfer rolls 67 are provided on the back surface side of the conveyor belt 63, respectively corresponding to the photo-sensitive drums 13 of the image-forming units 11. The photo-sensitive drums 13 and the paper sheet P on the conveyor belt 63 are kept in tight contact with each other by the transfer rolls 67. Further, a predetermined transfer bias is applied between the transfer rolls 67 and the photo-sensitive drums 13 by a transfer bias power supply.

Further, the sheet feed cassette 61 is provided with a pickup roll 71 which feeds out paper sheets P each at predetermined timing, and feeds the paper sheets P through a conveyor roll 72 and a registration roll 73 to transfer positions.

A fixing device 74 is provided on the sheet convey path 62, at a position in a further downstream side of the image-forming unit 11B which exists in the most downstream side among the image-forming units 11. Plural sheet output rolls 76 for outputting paper sheets are provided in the downstream side of the fixing device 74. Paper sheets are output ad stored in a container part 77 formed above the device housing 2.

In the image-forming device configured as described above, image formation is carried out through a process as follows.

In each of the image-forming units 11 (11Y, 11M, 11C, and 11B), the electric charge roll 14 electrically charges the photo-sensitive drum 13, and a latent image is formed on the photo-sensitive drum 13 by the exposure device 21. Thereafter, a visible image (toner image) is formed by the developing device 30.

Meanwhile, a paper sheet P is fed out at predetermined timing by the pickup roll 71 and is fed to an attraction position of the conveyor belt 63 through the conveyor roll 72 and the registration roll 73. The paper sheet P attracted by the conveyor belt 63 is then fed to transfer positions.

Toner images on the photo-sensitive drums 13 of the image forming units 11 are sequentially transferred to the paper sheet P by the transfer rolls 67. Toner images for respective color components on the paper sheet P are then fixed by the fixing device 74, and the paper sheet P subjected to the fixing of the toner images is then output to the container unit 77.

2. Outline of Process Cartridge

The process cartridge 12 has a photo-sensitive drum 13, an electric charge roll 14, a developing device 30, and a cleaning device 15.

3. Outline of Developing Device

Figure 2:
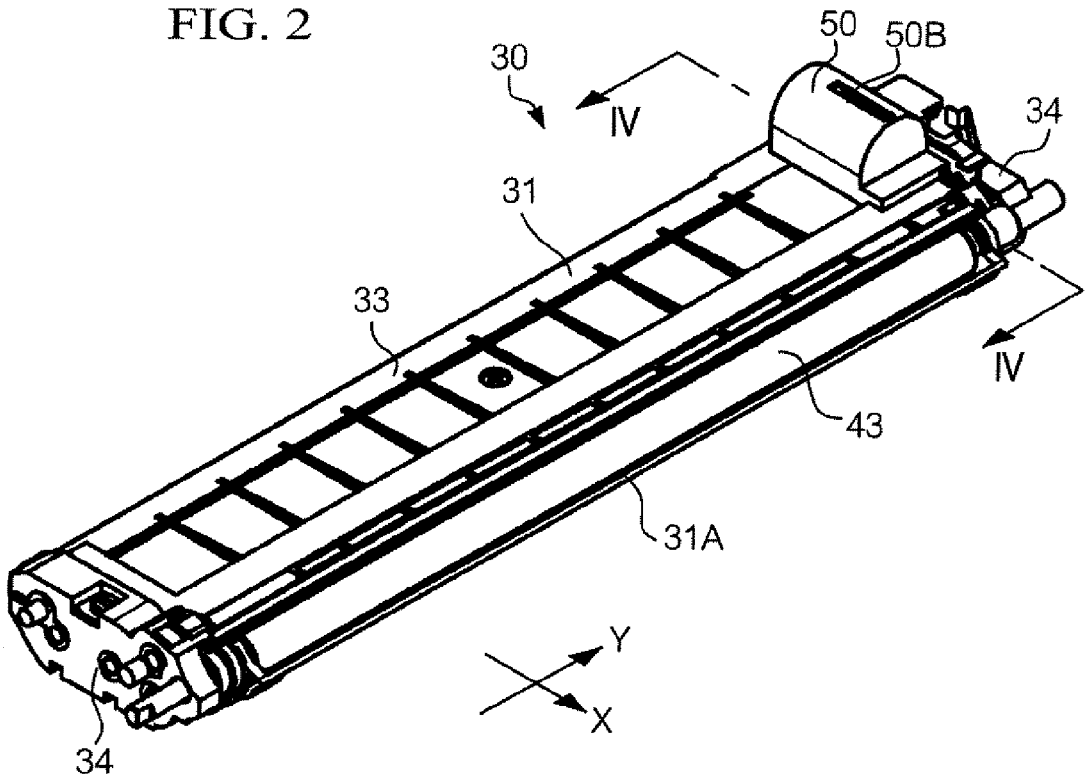
FIG. 2 is a perspective view showing a developing device according to the exemplary embodiment.
Figure 3:
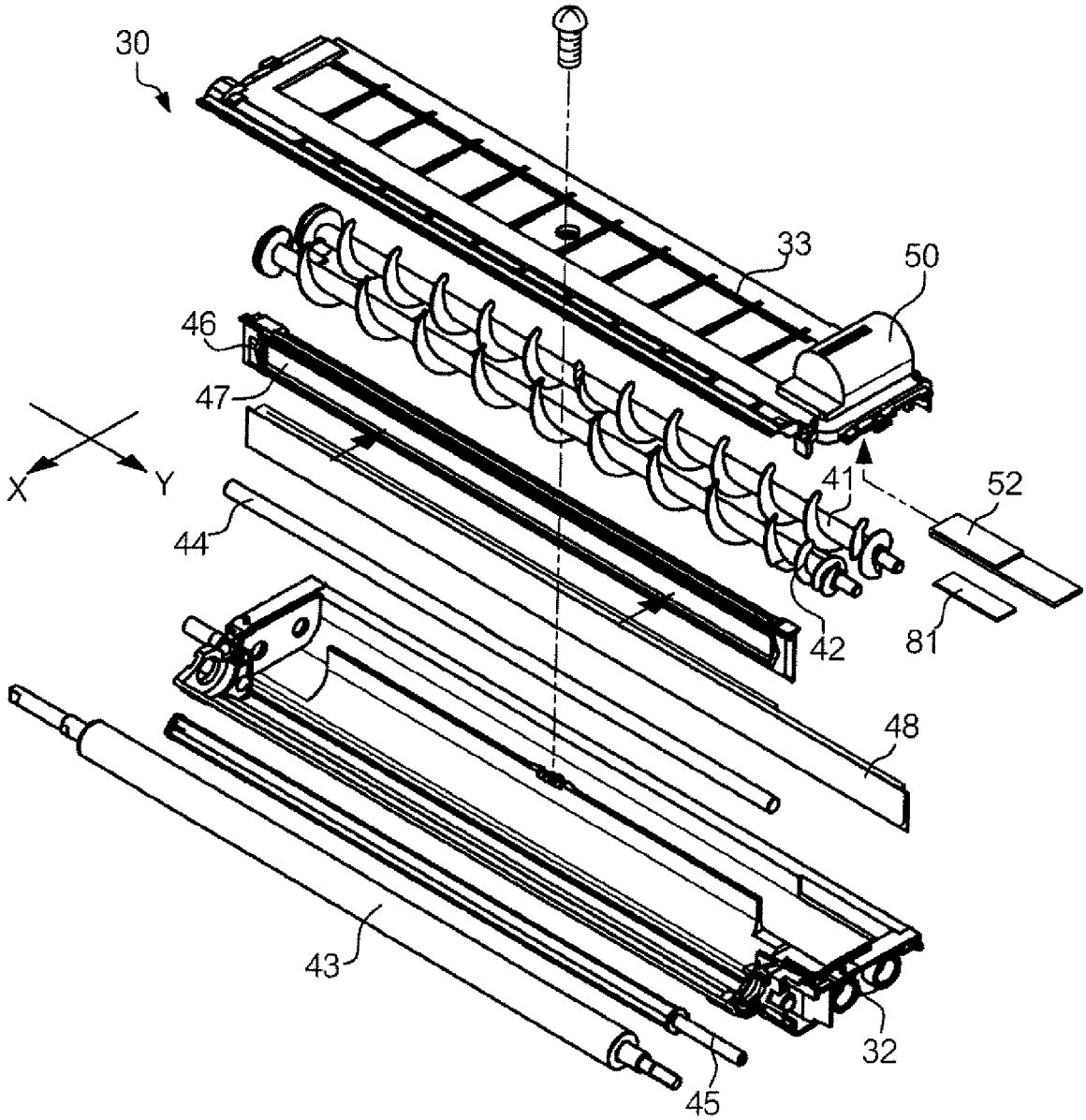
FIG. 3 is an exploded perspective view showing a main part of the developing device according to the exemplary embodiment.
Figure 4:
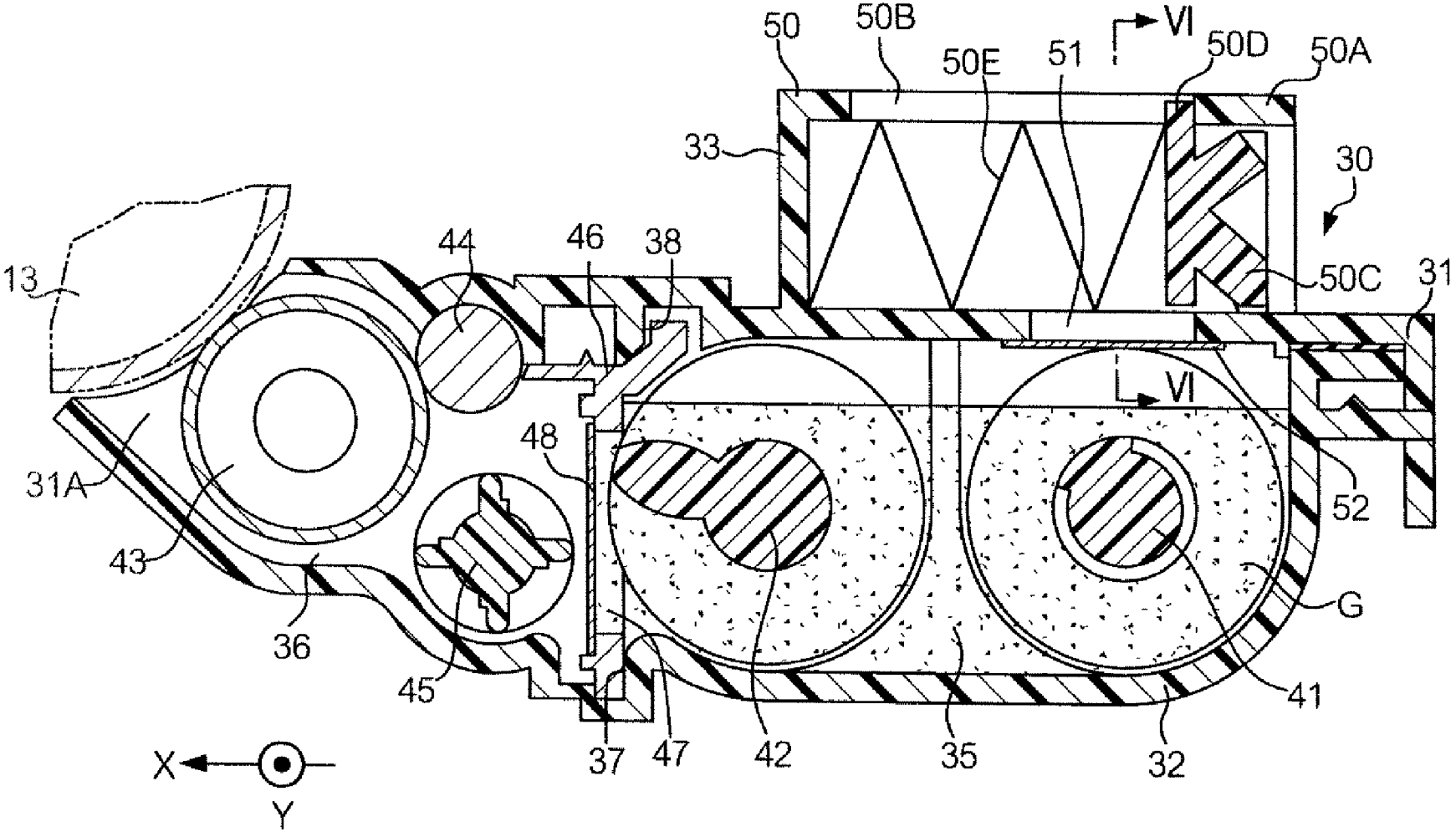
FIG. 4 is a partial cross-sectional view observed in a direction defined by arrows IV in FIG. 2.

FIGS. 2 to 4 are views showing a developing device 30 according to this exemplary embodiment. FIG. 2 is a perspective view of the developing device 30. FIG. 3 is an exploded perspective view of a main part of the developing device 30. FIG. 4 is a cross-sectional view seen from a direction defined by arrows IV in FIG. 2. In the description below, a widthwise direction and a lengthwise direction of the developing device 30 are X- and Y-axes, respectively.

As shown in FIGS. 2 and 3, the developing device 30 has a housing 31, an agitation auger 41, a feed auger 42, a magnetic roll 43, a trimmer member 44, and a paddle 45. The housing 31 includes an opening 31A and a chamber divided into a developer container part 35 and a developing part 36. The agitation auger 41 and feed auger 42 are located in the developer container part 35. The magnetic roll 43, trimmer member 44, and paddle 45 are located in the developing part 36.

A part of the magnetic roll 43 is exposed from the opening part 31A of the housing 31 and is located near the photo-sensitive drum 13. The trimmer member 44 regulates an mount of a developer held on a surface of the magnetic roll 43. A paddle 45 returns the developer released from the magnetic roll 43 after completion of development. Further, torque of a drive source is transmitted to the agitation auger 41, feed auger 42, magnetic roll 43, and paddle 45 through gears (none of which is shown in the figures).

The housing 31 is constituted of a lower housing 32, an upper housing 33, and side covers 34 arranged in the left and right sides of the upper and lower housings. The housing 31 is formed by assembling the parts 32 to 34, and is divided into the developer container part 35 and the developing part 36. A developer G is filled in the developer container part 35.

Further, as shown in FIG. 4, a groove is formed in the housing 31 at a position of a boundary between the developer container part 35 and the developing part 36. This groove is constituted of a lower groove 37 formed in the lower housing 32, an upper groove 38 formed in the upper housing 33, and the grooves formed in the side covers 34 which are omitted from the figure. When the developing device is not used, a partition frame 46 to which a sheet member 48 is bonded is engaged in the groove.

Meanwhile, a developer receiving part 50 is formed on one side of the upper housing 33 in the lengthwise direction.

The partition frame 46 and the sheet member 48 will now be described with reference to FIG. 5.

Figure 5:
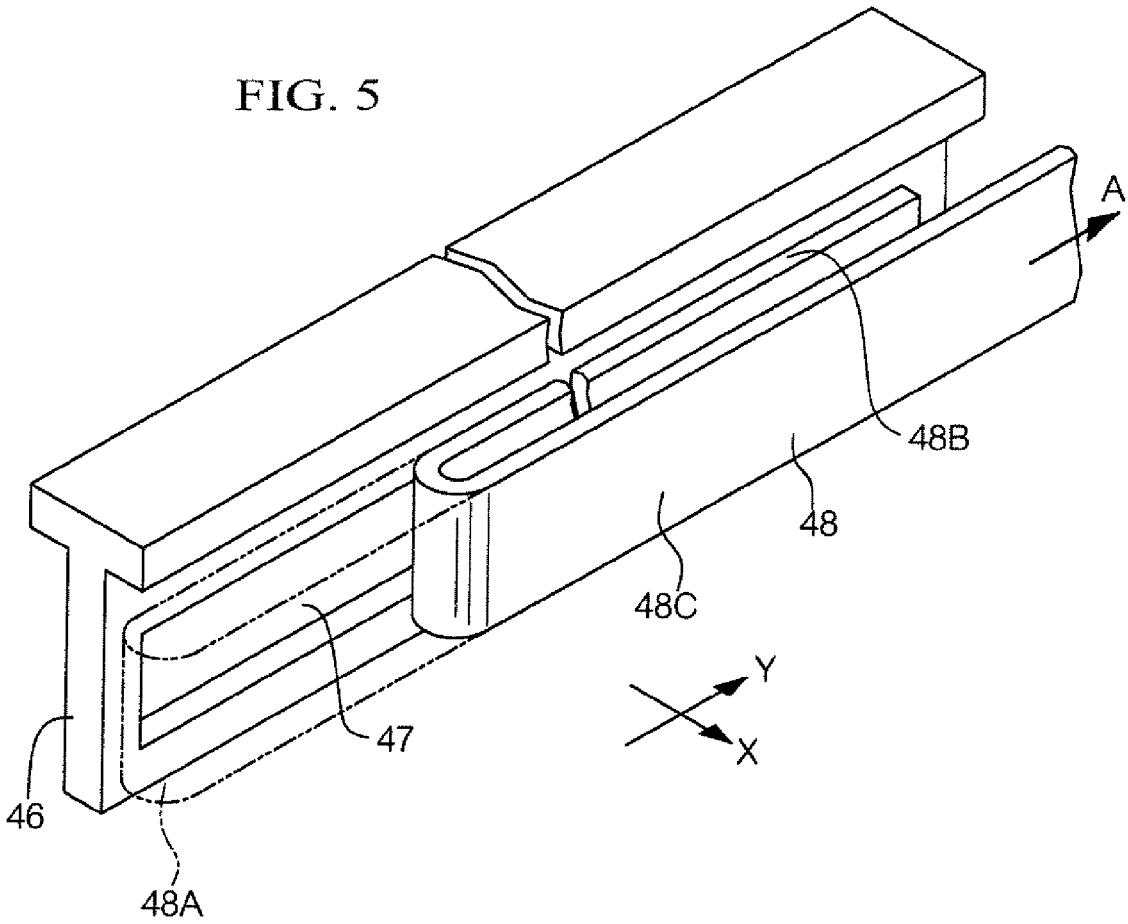
FIG. 5 is a perspective view showing a partition frame and a sheet member.

FIG. 5 shows a relationship between the partition frame 46 and the sheet member 48. The partition frame 46 has an outlet opening 47 through which the developer container part 35 and the developing part 36 communicate with each other. The outlet opening 47 communicates with the opening 31A (of the developing part 36) of the housing 31 through the developing part 36. As the sheet member 48 opens and/or closes, the developer container part 35 and the opening 31A (of the developing part 36) are connected to or disconnected to each other.

Further, the sheet member 48 is formed by layering a base layer and a thermal welding layer (both not shown). The base layer is formed, as a film having a thickness between 20 μm (micrometers) and 50 μm (micrometers), of polyester, polypropylene, polystyrene, or nylon. The thermal welding layer is formed as a film having a thickness between 20 μm (micrometers) and 40 μm (micrometers) of a polyethylene-based sealant, which contains ethylene vinyl acetate copolymer at several % to several ten %.

Further, the sheet member 48 is bonded, at the peripheries by an adhesive agent, to one side surface of the partition frame 46 so as to seal the outlet opening 47. The sheet member 48 is bonded so as to extend forward and return backward along a lengthwise direction (Y-axis) of the partition frame 46. Therefore, the sheet member 48 is twice as or more than twice as long as the developing device 30. A part of the sheet member 48, which is shown in a front side of FIG. 5 is a folded part 48A. A part of the sheet member 48 from a base end of the sheet member 48 to the folded part 48A is a forward part 48B which is bonded to the partition frame 46. A part of the sheet member 48 from the folded part 48A to a free end is a backward part 48C. This free end is led outside through a guide hole (not shown in the figures) formed between the upper housing 33 and the lower housing 32 and through a sheet path (not shown in the figures) in a side cover 34.

When separating the sheet member 48 off from the partition frame 46, the free end, which is led outside through the side cover 34 is pulled in a direction of an arrow A. The backward part 48C is pulled to the rear side in the figure, and the folding part 48A accordingly moves to the rear side. The rear side (in the figure) of the forward part 48B is accordingly separated from the partition frame 46. Thus, the sheet member 48 is separated from the partition frame 46 and the outlet opening 47 opens accordingly, thereby connecting the developer container part 35 to the developing part 36.

Figure 6:
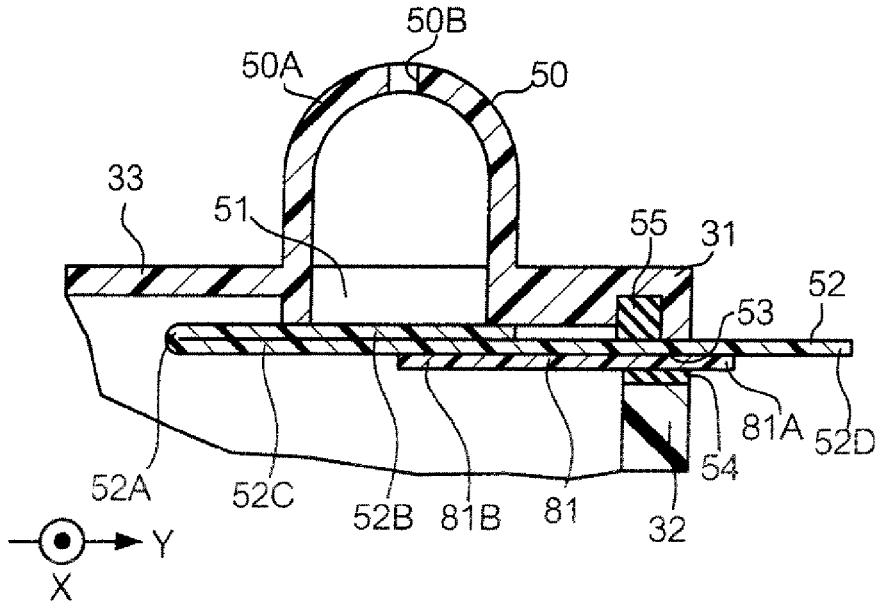
FIG. 6 is a partial cross-sectional view observed in a direction defined by arrows IV in FIG. 4.

Next, the structure of the developer receiving part 50 will now be described with reference to FIGS. 4 to 6. FIG. 6 is a cross-sectional view seen from a direction defined by arrows VI in FIG. 4.

The developer receiving part 50 is formed in a shape such as a half barrel on the upper housing 33. The developer receiving part 50 has an outer part 50A, a cover part 50C, and a spring 50E. The outer part 50A has a long regulation hole 50B formed extending in a lengthwise direction (X-axis direction) of the half barrel. A protrusion 50D to be engaged in the regulation hole 50B is protruded from the cover part 50C. The spring 50E presses the cover part 50C in a direction of closing the cover part 50C. An inlet opening 51 is formed at a position on the housing 31 where the developer receiving part 50 is formed.

Next, the developer receiving part 50 and a sheet member 52 will be described below. The sheet member 52 is bonded, at boundaries, to an inner surface of the upper housing 33 so as to seal the inlet opening 51. As shown in FIG. 6, the sheet member 52 has a folding part 52A in the left side of the figure. A part of the sheet member 52 from a base end to the folding part 52A is a forward part 52B, which is bonded to the peripheries of the inlet opening 51. A part of the sheet member 52 from the folding part 52A to a free end 52D is a backward part 52C. The free end 52D of the sheet member 52 is led outside through the guide hole 53 formed on the upper housing 33 and a seal member 54 bonded to the lower housing 32, and further through a sheet path (not shown in the figures) formed on the side covers 34.

4. Features of Exemplary Embodiment

The developing device 30 according to this exemplary embodiment has a feature that the sheet member 52, which seals the inlet opening 51, is provided with a press plate 81 as a loosening regulation unit, which is positioned between the backward part 52C of the sheet member 52 and the lower housing 32, as shown in FIG. 6. The sheet member 48, which seals the outlet opening 47, is also provided with a loosening regulation unit. The latter loosening regulation unit has the same structure and operations as the former loosening regulation unit and a detailed description of the latter loosening regulation unit will therefore be omitted herefrom.

The press plate 81 is sandwiched between the backward part 52C of the sheet member 52 and the seal member 54 (of the lower housing 32). A base end 81A of the press plate 81 protrudes outside from the housing 31, like the free end 52D of the sheet member 52. A distal end 81B of the press plate 81 extends to the center of the inlet opening 51.

The press plate 81 may have a width, which is between 25% and 100% of that of the sheet member 52 or longer than a size of the press plate 81 in the X-axis direction. Further, the press plate 81 is formed of a harder material than that of the sheet member 52. For example, a metal, plastic, or wooden material processed to have a thickness between 0.05 mm to 2 mm may be used as the press plate 81. This exemplary embodiment utilizes PET (polyethylene terephthalate) having a thickness of 0.1 mm.

In this manner, the press plate 81 has a shape which presses the backward part 52C toward the forward part 52B, so that the backward part 52C is prevented from floating up from the forward part 52B, thereby reducing flexure. Further, movement of the sheet member 52 is regulated since the sheet member 52 presses the backward part 52C toward the forward part 52B (toward the inlet opening 51).

In the developing device 30 according to this exemplary embodiments the press plate 81 provided for the sheet member 52 prevents the backward part 52C of the sheet member 52 from floating up from the foward part 52B. The backward part 52C is thereby prevented from loosening, and movement of the backward part 52C is regulated. As a result, even when the developing device 30 vibrates due to transportation or the like, the sheet member 52 is prevented from loosening and from creating a gap between parts of the sheet member 52 itself. Accordingly, a gap in which a developer G may be caught and accumulated is prevented from being created.

When pulling out the sheet member 52 by pulling the free end 52D to outside, the press plate 81 sandwiched between the sheet member 52 and the lower housing 32 is pulled out together with the sheet member 52. The press plate 81 is therefore prevented from remaining in the developer containing part 35, thereby closing the inlet opening 1, and from touching any other part.

5. Modifications

The invention is not limited to the exemplary embodiment as described above but is practicable in other various forms For example, the invention may be modified as follows in practice.

5-1. Modification 1

Figure 7:
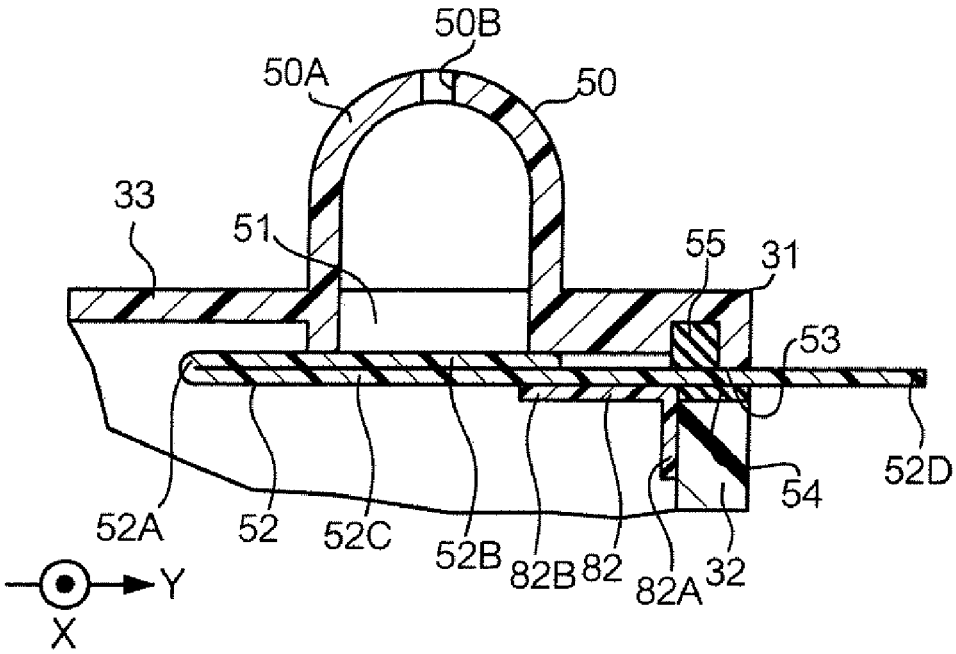
FIG. 7 is a partial cross-sectional view according to Modification 1, observed in the same direction as in FIG. 6.

In Modification 1, the lower housing 32 is provided with a press plate 82 as shown in FIG. 7. The press plate 82 is made of an L-shaped bent plate member. A base end 82A of the press plate 82 is fixed to inside of the housing 32 on a side of the seal member 54. A top end 82B extends to an edge of the inlet opening 51. The press plate 82 is formed of a harder material than that of the sheet member 52.

The press plate 82 described above operates and functions in the same manner as in the exemplary embodiment. That is, the press plate 82 prevents the backward part 52C from floating up from the forward part 52B. The backward part 52C is thereby prevented from loosening, and movement of the backward part 52C is regulated.

5-2. Modification 2

Figure 8:
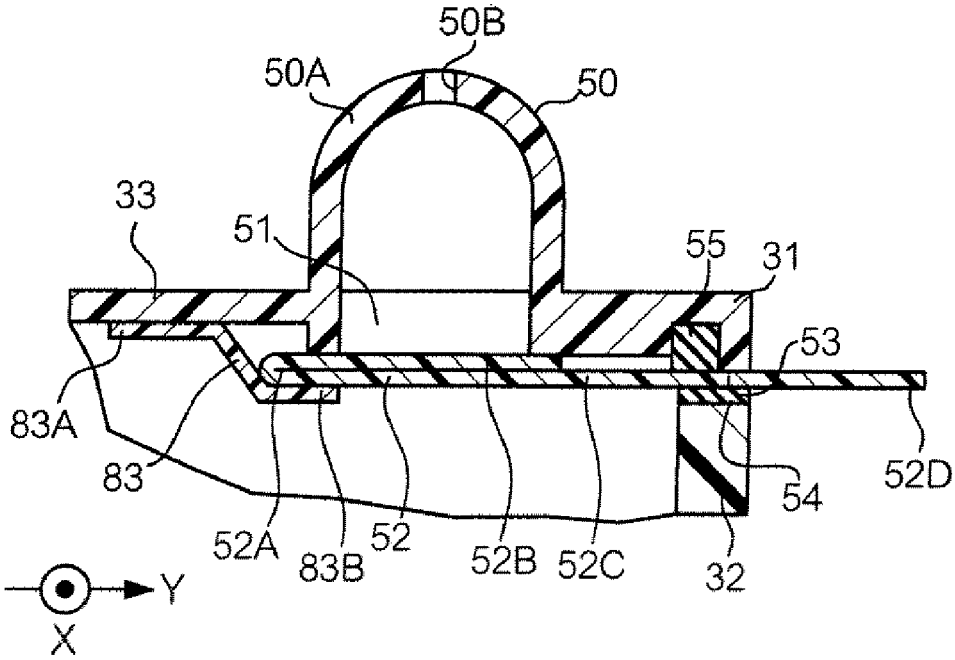
FIG. 8 is a perspective view according to Modification 3, observed in the same direction as in FIG. 5.

In Modification 2, a press plate 83 as shown in FIG. 8 is provided in the upper housing 33 and the press plate 83 is made of a plate member, which is bent like inverted "V". A base end 83A of the press plate 83 is fixed to inside of the upper housing 33 in a deep side of the inlet opening 51. A front end 83B extends to the folded part 52A of the sheet member 52 (or to an edge of the inlet opening 51 in the other side). The press plate 83 is formed of a harder material than that of the sheet member 52.

The press plate 83 described above regulates movement of the folded part of the sheet member 52. Accordingly, the backward part 52C is prevented from floating up from the forward part 52B and from loosening as a result.

5-3. Modification 3

Figure 9:
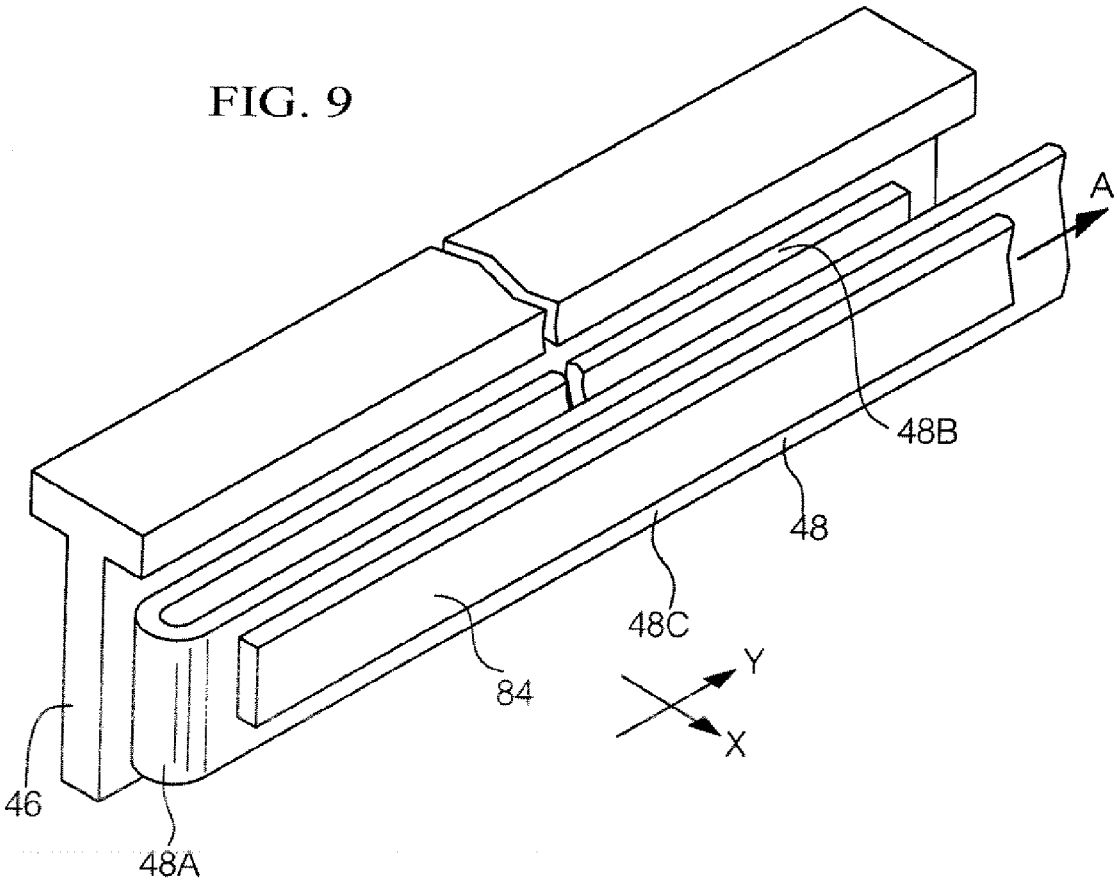
FIG. 9 is a perspective view showing a partition frame with sheet member and press plate.

In Modification 3, a press plate 84 as shown in FIG. 9 is bonded to the backward part 52C of the sheet member 48. The press plate 84 is formed of a harder material than that of the sheet member 48.

The press plate 84 prevents the backward part 52C of the sheet member 48 from floating up from the forward part 52B and from loosening as a result.

5-4. Modification 4

The exemplary embodiment and Modifications 1 and 2 have exemplified a case that the sheet member 52 is prevented from loosening by a press plate as a loosening regulation unit. Modification 3 has exemplified a case that the sheet member 48 is prevented from loosening by a press plate. However, press plates may be provided for both of the sheet members 48 and 52.

Further, the loosening regulation unit is not limited to a press plate but may be any member insofar as the member regulates loosening of the sheet member.

5-5. Modification 5

The exemplary embodiment and Modifications have exemplified a case that a loosening regulation unit is used in the developing device 30. Needless to say, however, the invention is not limited to this case but is applicable to a developer container, which has a developer containing part and uses a sheet member to seal an opening in a developer containing part.

What is claimed is:

1. A developer container comprising:

a housing that has a developer containing part and an opening, the developer containing part containing a developer, and the opening allowing the developer to flow through;

a sheet member that is provided in the housing, seals the opening from inside the developer containing part when unused, and is pulled out in one direction to open the opening when used; and a loosening regulation unit that presses a part of the sheet member to the housing, wherein the housing has a guide hole, the guide hole allowing the sheet member to be inserted in when sealing the opening with the sheet member, and guiding the sheet member when the sheet member is pulled out;

the sheet member is folded back to the housing, and is constituted of a forward part and a backward part, the forward part extending from a base end to a part at which the sheet member is folded, and the backward part overlapping the forward part from the folded part and having a free end protruding outside the housing through the guide hole;

a part of the loosening regulation unit is fixed to the housing, the part being at an opposite side of the guide hole in relation to the folded part; and another part of the loosening regulation unit presses at least a part of the forward part and the back part including the folded part.

2. The developer container according to claim 1, wherein the loosening regulation unit is formed of a harder sheet member than that of the sheet member.

3. A process cartridge comprising:

an image carrier having a surface on which an electrostatic latent image is formed; and a developing device including, a housing that has a developer containing part and an opening, the developer containing part containing a developer, and the opening allowing the developer to flow through;

a sheet member that is provided in the housing, seals the opening from inside the developer containing part when unused, and is pulled out in one direction to open the opening when used;

a loosening regulation unit that presses a part of the sheet member to the housing; and a developer carrier that is rotatable attached to the housing, and holds and carries the developer contained in the developer containing part, to a developing area facing the image carrier, wherein the housing has a guide hole, the guide hole allowing the sheet member to be inserted in when sealing the opening with the sheet member, and guiding the sheet member when the sheet member is pulled out;

the sheet member is folded back in the housing, and is constituted of a forward part and a backward part the forward part extending from a base end to a part at which the sheet member is folded, and the backward part overlapping the forward part from the folded part and having a free end protruding outside the housing through the guide hole;

a part of the loosening regulation unit is fixed to the housing, the part being at an opposite side of the guide hole in relation to the folded part and another part of the loosening regulation unit presses at least a part of the forward art and the backward part including the folded part; and wherein the developing device visualizes the electrostatic latent image formed on the surface of the image carrier by the developer.

4. An image forming device comprising:

an image carrier having a surface on which an electrostatic latent image is formed;

a developing device including, a housing that has a developer containing part and an opening, the developer containing part containing a developer, and the opening allowing the developer to flow through;

a sheet member that is provided in the housing, seals the opening from inside the developer containing part when unused, and is pulled out in one direction to open the opening when used;

a loosening regulation unit that presses a part of the sheet member to the housing; and a developer carrier that is rotatable attached to the housing, and holds and carries the developer contained in the developer containing part, to a developing area facing the image carrier, wherein the housing has a guide hole, the guide hole allowing the sheet member to be inserted in when sealing the opening with the sheet member, and guiding the sheet member when the sheet member is pulled out;

the sheet member is folded back in the housing, and is constituted of a forward art and a backward part the forward part extending from a base end to a part at which the sheet member is folded, and the backward part overlapping the forward part from the folded part and having a free end protruding outside the housing through the guide hole;

a part of the loosening regulation unit is fixed to the housing, the part being at an opposite side of the guide hole in relation to the folded part and another part of the loosening regulation unit presses at least a part of the forward art and the backward part including the folded part; and wherein the developing device visualizes the electrostatic latent image formed on the surface of the image carrier by the developer;

a latent image forming unit that forms the electrostatic latent image on the image carrier; and a transfer unit that transfers a toner image visualized by the developing device to a recording medium.

5. A developing device comprising:

a housing that has a developer containing part and an opening, the developer containing part containing a developer, and the opening allowing the developer to flow through;

a sheet member that is provided in the housing, seals the opening from inside the developer containing part when unused, and is pulled out in one direction to open the opening when used;

a loosening regulation unit that leosening presses a part of the sheet member to the housing; and a developer carrier that is rotatable attached to the housing, and holds and carries the developer contained in the developer containing part, to a developing area facing an image carrier, wherein the housing has a guide hole that allows the sheet member to be inserted in when sealing the opening with the sheet member, and guides the sheet member when the sheet member is pulled out the sheet member is folded back in the housing, and is constituted of a forward part and a backward part, the forward part extending from a base end to a part at which the sheet member is folded, and the backward part overlapping the forward part from the folded part and having a free end protruding outside the housing through the guide hole;

a part of the loosening regulation unit is fixed to the housing, the part being at an opposite side of the guide hole in relation to the folded part; and another part of the loosening regulation unit presses at least a part of the forward part and the backward part including the folded part.

6. A developer container comprising:

a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out; and a protruding part that is formed of a flexible member, protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening.

7. The developer container according to claim 6, wherein the pressing part is formed of a flexible sheet member.

8. The developer container according to claim 6, wherein the pressing part is formed of a sheet material harder than that of the sheet member.

9. A developer container comprising:

a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out; and a protruding part that protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening.

10. The developer container according to claim 9, wherein the pressing part is formed of a flexible sheet member.

11. The developer container according to claim 9, wherein the pressing part is formed of a sheet material harder than that of the sheet member.

12. A developing device comprising;

a developer container including, a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out; and a protruding part that is formed of a flexible member, protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening; and a developer carrier that is rotatably attached to the housing, and holds and carries the developer contained in the developer containing part, to a developing area facing an image carrier.

13. A developing device comprising:

a developer container including, a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out; and a protruding part that protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening; and a developer carrier that is rotatably attached to the housing, and holds and carries the developer contained in the developer containing part, to a developing area facing an image carrier.

14. A process cartridge comprising:

an image carrier having a surface on which an electrostatic latent image is formed; and a developing device including, a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out;

a protruding part that is formed of a flexible member, protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening; and a developer carrier that is rotatably attached to the housing, and holds and carries the developer contained in the developer containing part, to a developing area facing the image carrier, wherein the developing device develops the electrostatic latent image formed on the surface of the image carrier by the developer.

15. A process cartridge comprising:

an image carrier having a surface on which an electrostatic latent image is formed; and a developing device including, a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out;

a protruding part that protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening; and a developer carrier that is rotatably attached to the housing, and holds and carries the developer contained in the developer containing part, to a developing area facing the image carrier, wherein the developing device develops the electrostatic latent image formed on the surface of the image carrier by the developer.

16. An image forming device comprising:

an image carrier having a surface on which an electrostatic latent image is formed;

a developing device including, a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out;

a protruding part that is formed of a flexible member, protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening; and a developer carrier that is rotatably attached to the housing, and holds and carries the developer contained in the developer containing part, to a developing area facing the image carrier, wherein the developing device develops the electrostatic latent image formed on the surface of the image carrier by the developer;

a latent image forming unit forms the electrostatic latent image on the image carrier; and a transfer unit transfers a toner image developed by the developing device to a recording medium.

17. An image forming device comprising;

an image carrier having a surface on which an electrostatic latent image is formed;

a developing device including, a housing that has a developer containing part and an opening, the developer containing part containing a developer, and the opening allowing the developer to flow therethrough;

a sheet member that is bonded to the housing to seal the opening, and is pulled out in a predetermined direction and is separated from the housing to open the opening, the housing having a guide hole into which the sheet member can be inserted when sealing the opening with the sheet member, and which guides the sheet member when the sheet member is pulled out, the sheet member being folded back in the housing, sealing the opening, and the sheet member being constituted of a forward part and a backward part, the forward part extending from an end to a part at which the sheet member is folded, and the backward part overlapping the forward part from the folded part and having another end protruding outside the housing through the guide hole;

a pressing part that presses a part of the backward part toward a side of the opening downstream of the opening in a direction in which the sheet member is pulled out;

a protruding part that protrudes downstream of the guide hole in the direction in which the sheet member is pulled out, and contacts the sheet member when the sheet member is pulled out to an outside of the housing in a direction in which the sheet member is moved away from the side of the opening to press the sheet member toward the side of the opening; and a developer carrier that is rotatably attached to the housing, and holds and carries the developer contained in the developer containing part, to a developing area facing the image carrier, wherein the developing device develops the electrostatic latent image formed on the surface of the image carrier by the developer;

a latent image forming unit forms the electrostatic latent image on the image carrier; and a transfer unit transfers a toner image developed by the developing device to a recording medium.

* * * * *